US011879715B1

(12) United States Patent
Rogers

(10) Patent No.: US 11,879,715 B1
(45) **Date of Patent: *Jan. 23, 2024**

(54) LESS-LETHAL AMMUNITION AND METHODS FOR MAKING LESS-LETHAL AMMUNITION

(71) Applicant: Avert Industries, LLC, Jefferson, GA (US)

(72) Inventor: John Doyle Rogers, Jefferson, GA (US)

(73) Assignee: Avert Industries, LLC, Jefferson, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,384

(22) Filed: Dec. 3, 2021

Related U.S. Application Data

(63) Continuation of application No. 16/745,494, filed on Jan. 17, 2020, now Pat. No. 11,193,741.

(60) Provisional application No. 62/794,735, filed on Jan. 21, 2019.

(51) Int. Cl.

| | |
|---|---|
| ***F42B 7/02*** | (2006.01) |
| ***F42B 7/12*** | (2006.01) |
| ***F42B 7/08*** | (2006.01) |
| ***F42B 12/74*** | (2006.01) |
| ***F42B 30/00*** | (2006.01) |

(52) U.S. Cl.
CPC ..... *F42B 7/08* (2013.01); *F42B 12/745* (2013.01); *F42B 7/02* (2013.01); *F42B 7/12* (2013.01); *F42B 30/00* (2013.01)

(58) Field of Classification Search
CPC ..... F42B 7/00; F42B 7/02; F42B 7/06; F42B 7/08; F42B 7/10; F42B 7/12; F42B 12/745; F42B 30/00; F42B 8/02; F42B 8/12
USPC ..... 102/444, 448–463, 501, 502
See application file for complete search history.

(56) References Cited

U.S. PATENT DOCUMENTS

| | | | | |
|---|---|---|---|---|
| 3,059,578 | A * | 10/1962 | Hegge | F42B 12/64 102/506 |
| 3,442,214 | A | 5/1969 | Huskins | |
| 3,877,381 | A | 4/1975 | McCoy | |
| 3,952,662 | A * | 4/1976 | Greenlees | F42B 7/10 102/400 |
| 5,225,628 | A | 7/1993 | Heiny | |
| 6,283,037 | B1 * | 9/2001 | Sclafani | F42B 12/34 102/513 |
| 6,546,874 | B2 | 4/2003 | Vasel | |
| 7,350,465 | B2 * | 4/2008 | Keegstra | F42B 10/38 102/517 |
| 7,814,820 | B2 | 10/2010 | Menefee | |

(Continued)

FOREIGN PATENT DOCUMENTS

| | | | |
|---|---|---|---|
| GB | 10473 | 10/1910 | |
| UA | 28472 U * | 12/2007 | F42B 30/00 |

OTHER PUBLICATIONS

Machine translation of UA-28472-U (Year: 2007).*

(Continued)

*Primary Examiner* — James S Bergin
(74) *Attorney, Agent, or Firm* — Hartman & Citrin LLC

(57) ABSTRACT

A less-lethal projectile is disclosed herein. The less-lethal projectile can include a case having an interior; a powder charge located in the interior; and a projectile located in the interior, adjacent to the buffer, wherein the projectile is formed from a material that includes plastisol.

20 Claims, 7 Drawing Sheets

(56) References Cited

U.S. PATENT DOCUMENTS

| | | | | |
|---|---|---|---|---|
| 8,276,519 | B2 | 10/2012 | Menefee, III | |
| 9,429,405 | B1 * | 8/2016 | Balzano | F42B 12/56 |
| 11,009,321 | B2 * | 5/2021 | Buys | F42B 10/06 |
| 11,181,350 | B2 * | 11/2021 | McDevitt | F42B 7/08 |
| 11,193,741 | B1 * | 12/2021 | Rogers | F42B 12/745 |
| 2008/0223245 | A1 | 9/2008 | Stevens | |
| 2009/0254171 | A1 | 10/2009 | Heikkila | |
| 2014/0230680 | A1 * | 8/2014 | Meller | F42B 12/00 102/502 |
| 2015/0308804 | A1 | 10/2015 | Seeman | |
| 2021/0140747 | A1 | 5/2021 | McDevitt | |

OTHER PUBLICATIONS

U.S. Office Action dated Dec. 16, 2020 in U.S. Appl. No. 16/745,494.
U.S. Notice of Allowance dated Jul. 20, 2021 in U.S. Appl. No. 16/745,494.

* cited by examiner

LESS-LETHAL AMMUNITION AND METHODS FOR MAKING LESS-LETHAL AMMUNITION

CROSS-REFERENCE TO RELATED APPLICATION

This application is a continuation of and claims priority to U.S. patent application Ser. No. 16/745,494, entitled "Less-Lethal Ammunition and Methods for Making Less-Lethal Ammunition," filed Jan. 17, 2020, now U.S. Pat. No. 11,193,741, which is incorporated herein by reference in its entirety, and which is a nonprovisional of and claims priority to U.S. Patent Application No. 62/794,735, entitled "Less-Lethal Ammunition and Methods for Making Less-Lethal Ammunition," filed Jan. 21, 2019, now expired, which is incorporated herein by reference in its entirety.

BACKGROUND

Unless otherwise indicated herein, all disclosures in the background are not prior art to the claims in this application and are not admitted to be prior art by inclusion in this section.

Current embodiments of non-lethal ammunition and/or non-lethal projectiles can fail under certain circumstances, resulting in "non-lethal" ammunition and/or projectiles that can kill and/or severely injure the intended targets and/or bystanders. For example, rubber-coated bullets (or balls) are sometimes used as projectiles in "non-lethal" ammunition. The rubber-coated bullets, however, are typically rubber or plastic coated steel balls or other shapes that can penetrate skin and/or bone and can cause severe injury and/or death. Similarly, some "non-lethal" ammunition and/or projectiles can be formed by disposing a springy or flexible coating to steel or other hard materials, resulting in projectiles that can bounce and/or ricochet causing harm to intended targets, the shooter, bystanders, and/or inanimate objects in the vicinity of use of such ammunition.

SUMMARY

It should be appreciated that this summary is provided to introduce a selection of concepts associated with the concepts and technologies disclosed herein in a simplified form. The concepts discussed in this summary are further described below in the detailed description. This summary does not limit the scope of the claimed subject matter and/or the disclosure thereof in the detailed description and drawings in any way.

The present disclosure is directed to less-lethal ammunition (e.g., for firearms) and methods for making less-lethal ammunition (e.g., for firearms). As used herein, the term "less-lethal," and variants thereof, is used to describe ammunition and/or projectiles thereof that are designed with an intent not to kill the intended target and/or others. It should be understood, however, that embodiments of the ammunition disclosed herein and projectiles thereof, can be lethal to the intended target and/or to others based on a variety of factors such as, for example, age, health, and/or fortitude of the person contacted by the projectiles associated with the ammunition illustrated and described herein; point(s) on the body contacted by the projectiles associated with the ammunition illustrated and described herein; and/or other factors as generally is understood by those in the industry.

A less-lethal projectile as disclosed herein can be formed from a synthetic material such as plastisol or other materials.

In some embodiments, plastisol or other materials can be mixed with and/or can include a weighting material that can include particles of a material other than plastisol. The weighting material (e.g., tungsten, steel, bismuth, or the like) can be dispersed throughout the plastisol or other material and shaped to form a less-lethal projectile. The resulting plastisol and weighting material can be shaped to form projectiles having various different configurations based on needs and/or desired use (e.g., the shape of the projectiles can be changed to affect flight and/or trajectory; size can be changed to affect effective range; etc.). According to various embodiments of the concepts and technologies disclosed herein, a less-lethal projectile can be formed that provides effective and reliable performance (e.g., small variance in trajectory (accuracy); small variance in muzzle energy; small variance in weight; etc.) to create more reliable less-lethal ammunition than what currently is known. Also, because the less-lethal projectiles can be made with easily accessible materials and formed into custom shapes, the less-lethal ammunition illustrated and described herein can be relatively inexpensive relative to other non-lethal ammunition that is known (e.g., rubber-coated bullets, bean bags, etc.).

According to one embodiment of the concepts and technologies disclosed herein, a less-lethal ammunition is disclosed. The less-lethal ammunition can include a case having a first end, a second end, and an interior; a primer located at the first end; a powder charge located in the interior; a gas seal located in the interior, adjacent to the powder charge; a buffer located in the interior, adjacent to the gas seal; and a projectile located in the interior, adjacent to the buffer. The projectile can be formed from a material including a bearing material and a weighting substance dispersed within the bearing material, the material including between ten percent and sixty percent by volume of the weighting substance. The less-lethal ammunition further can include an over the shot card located in the interior, adjacent to the projectile.

In some embodiments, the weighting substance can include bismuth. In some embodiments, the bearing material can include plastisol. In some embodiments, the weighting substance can include tungsten. In some embodiments, the bearing material can include plastisol. In some embodiments, the buffer can include a buffer material. In some embodiments, the buffer material can include walnut grit. In some embodiments, the projectile can include multiple projectiles. In some embodiments, the over the shot card can compress the projectiles.

According to another embodiment of the concepts and technologies disclosed herein, another embodiment of less-lethal ammunition is disclosed. The less-lethal ammunition can include a case having an interior and a primer; a powder charge located in the interior; and a projectile located in the interior. The projectile can be formed from a material including a bearing material and a weighting substance dispersed within the bearing material.

In some embodiments, the weighting substance can include bismuth. In some embodiments, the bearing material can include plastisol. In some embodiments, the less-lethal ammunition further can include a gas seal located between the powder charge and the projectile. In some embodiments, the less-lethal ammunition further can include a buffer located between the gas seal and the projectile. In some embodiments, the projectile can include multiple projectiles. In some embodiments, each of the multiple projectiles can be substantially spherical. In some embodiments, the projectile is conical. In some embodiments, the material can include between ten percent and sixty percent by volume of the weighting substance.

According to one embodiment of the concepts and technologies disclosed herein, a less-lethal ammunition is disclosed. The less-lethal ammunition can include a case having an interior; a powder charge located in the interior; and a projectile located in the interior. The projectile can be formed from a material including a bearing material and a weighting substance dispersed within the bearing material.

In some embodiments, the weighting substance can include bismuth. In some embodiments, the bearing material can include plastisol. In some embodiments, the less-lethal ammunition further can include a gas seal located between the powder charge and a buffer. The buffer can be located between the gas seal and the projectile.

The features, functions, and advantages discussed herein can be achieved independently in various embodiments of the concepts and technologies disclosed herein, or may be combined in yet other embodiments, further details of which can be seen with reference to the following description and drawings. As noted above, the foregoing summary is illustrative only and is not limiting in any way. In addition to the illustrative aspects, embodiments, and features described above, further aspects, embodiments, and features will become apparent by reference to the drawings and the following detailed description.

DETAILED DESCRIPTION

Figure 1:
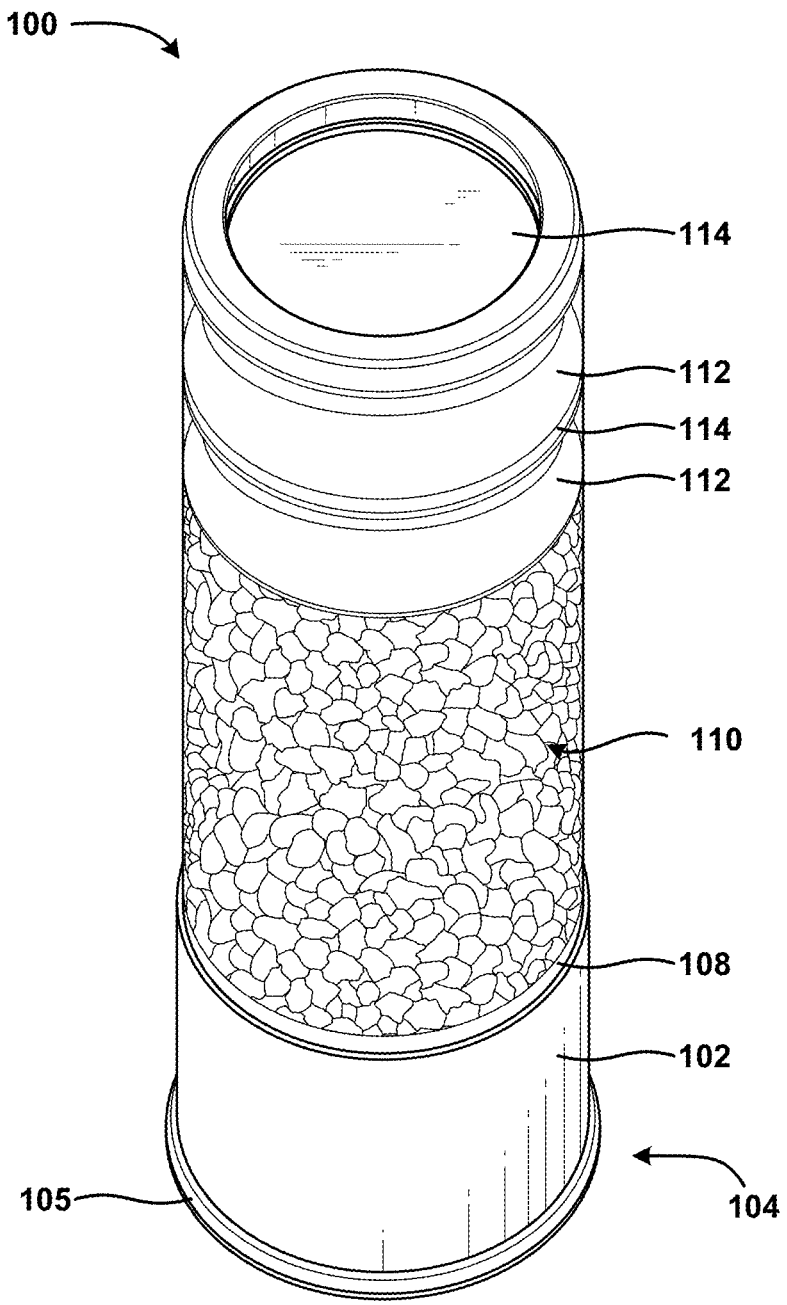
FIG. 1 is a line drawing showing a first perspective view of less-lethal ammunition, according to one example embodiment of the concepts and technologies disclosed herein.

In the following detailed description, references are made to the accompanying drawings that form a part hereof and that show, by way of illustration, specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of less-lethal ammunition and methods of making less-lethal ammunition will be described.

Figure 2:
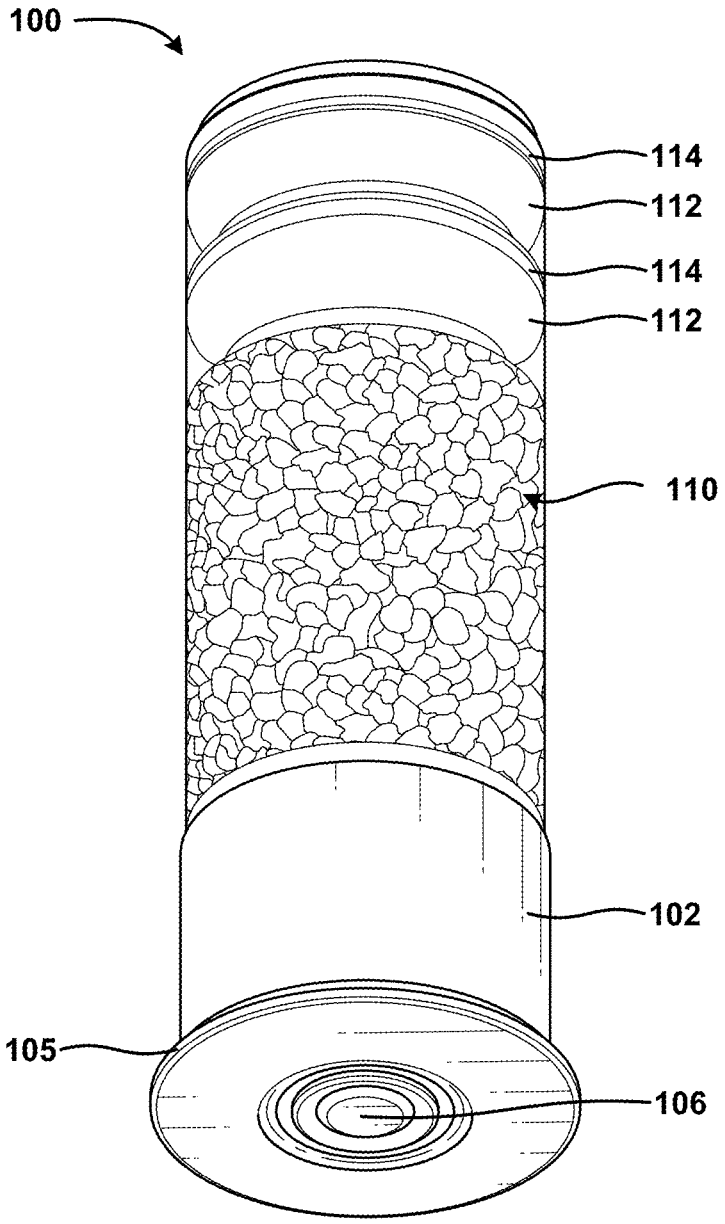
FIG. 2 is a line drawing showing another perspective view of less-lethal ammunition, according to one example embodiment of the concepts and technologies disclosed herein.
Figure 3:
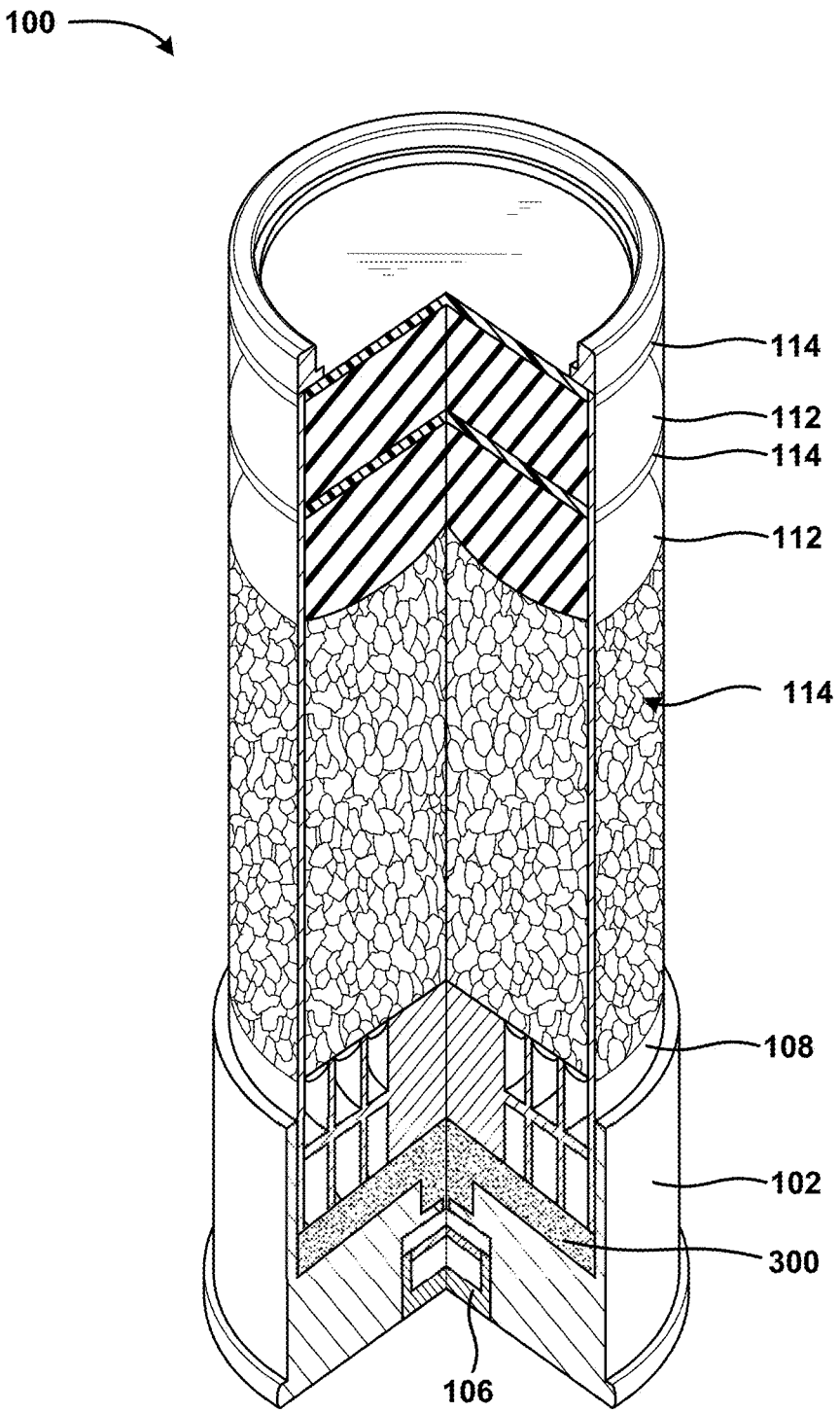
FIG. 3 is a line drawing showing a cut away view of less-lethal ammunition, according to one example embodiment of the concepts and technologies disclosed herein.

Referring first to FIGS. 1-3, an example of less-lethal ammunition 100 will be described according to an example embodiment of the concepts and technologies disclosed herein. As shown in FIGS. 1-3, an example of less-lethal ammunition 100 is shown. While the described embodiment relates to less-lethal ammunition for use in a shotgun, it should be understood that other types of less-lethal ammunition and projectiles are possible and are contemplated. For example, various embodiments of the concepts and technologies disclosed herein include less-lethal projectiles and ammunition for black powder firearms, rimfire firearms, shotguns, centerfire firearms, and/or other firearms and/or weaponry. As such, the described embodiment should be understood as being illustrative of some of the concepts and technologies disclosed herein and should not be construed as being limiting in any way.

In the example embodiment of the less-lethal ammunition 100 shown in FIGS. 1 and 2, the less-lethal ammunition 100 can appear at first glance to be substantially similar to a traditional shotgun shell. According to various embodiments of the concepts and technologies disclosed herein, however, the components of the less-lethal ammunition 100 illustrated and described herein can cause the less-lethal ammunition 100 to function in a different manner than traditional less-lethal ammunition, resulting in projectiles that may be less likely (relative to existing non-lethal ammunition and/or projectiles) to penetrate skin, bone, or other targets. Furthermore, embodiments of the less-lethal ammunition 100 and/or projectiles illustrated and described herein can be configured not to ricochet and/or bounce off targets and/or other objects in the vicinity of the shooter, the targets, or the like. It should be understood that this example is illustrative, and therefore should not be construed as being limiting in any way.

As generally is understood, the less-lethal ammunition 100 can include a hull or case 102 (hereinafter referred to as case 102). As is generally understood, the case 102 can be formed from metal, plastic, and/or other materials. The case 102 can have a first end 104. The first end 104 can include various structures as is generally understood. For example, the first end 104 can be designed to house a primer 106 (best visible in FIG. 2), and can include a rim 105. The rim 105 can be included to prevent the case 102 from passing through the bore and/or into the barrel during loading in a firearm, to provide a seating surface corresponding to an interface between the case 102 and the bore of the firearm, to provide a gripping surface for an ejector of the firearm, etc. Because the rim 105 can provide additional and/or alternative functions, it should be understood that these examples are illustrative, and therefore should not be construed as being limiting in any way.

The function of the first end 104, the rim 105, the primer 106, and/or other structures are generally known and therefore will not be described in additional detail herein. Various additional components can be loaded into the case 102 of the less-lethal ammunition 100, some example embodiments of which are shown and will be described in more detail with reference to FIGS. 4-6. These components, however, are partially visible in FIGS. 1-3 and therefore may be mentioned briefly below with reference to FIGS. 1-3.

According to various embodiments of the concepts and technologies disclosed herein, the less-lethal ammunition 100 can be formed by loading a powder charge 300 into the case 102. The powder charge 300 can include an amount of gunpowder or other suitable propellant into the case 102. The purpose of the powder charge 300 (best visible in FIG. 3), the function of a powder charge 300, and the loading of the powder charge 300 into a case 102 are generally understood. The amount of propellant used to provide the powder charge 300, as well as the specific powder or other propellant used in the powder charge, can be varied, as generally is understood.

Figure 4:
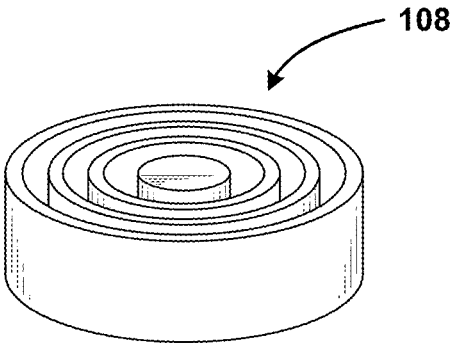
FIG. 4 is a line drawing showing a gas seal that can be used in some embodiments of less-lethal ammunition, according to one example embodiment of the concepts and technologies disclosed herein.

According to various embodiments of the concepts and technologies disclosed herein, a gas seal, wad, or the like (hereinafter referred to as a "gas seal") 108 can be located in the case 102. According to various embodiments of the concepts and technologies disclosed herein, the gas seal 108 can be located in the case 102 on top of the gunpowder or other propellant used to provide the powder charge 300. The edge of the gas seal 108 is visible in FIG. 1 and the gas seal 108 is best seen in FIG. 3. The function of the wad/gas seal is also generally understood and therefore will not be described in detail herein. FIG. 4 illustrates an example of the gas seal 108 that can be used in some embodiments of the less-lethal ammunition 100 illustrated and described herein. The height, radius, structure, shape, and/or other aspects of the gas seal 108 can be varied in various embodiments of the less-lethal ammunition 100, as generally is understood.

According to various embodiments of the concepts and technologies disclosed herein, a buffer 110 can be formed in the case 102. In the illustrated embodiment, the buffer 110 is located on top of the gas seal 108. In particular, the material that provides the buffer 110 can be loaded into the case 102 after the powder charge 300 and the gas seal 108 is loaded, in some embodiments. It should be understood that this example is illustrative, and therefore should not be construed as being limiting in any way.

According to various embodiments of the concepts and technologies disclosed herein, the buffer 110 can be included to increase a back pressure in the barrel (between the projectiles and the powder charge 300 and gas seal 108). The back pressure can be created (by the buffer 110) to encourage ignition of the powder or other propellant in the powder charge 300 before the projectile(s) are expelled from the barrel of the firearm firing the less-lethal ammunition 100. Thus, the buffer 110 can be included to reduce or even eliminate the discharge, from the barrel of the firearm firing the less-lethal ammunition 100, of unburnt powder or other propellant. In some embodiments of the concepts and technologies disclosed herein, by reducing or eliminating the discharge of unburnt powder or other propellant (e.g., by ensuring the powder is burnt), the buffer 110 can be used to increase pressure in the barrel of the firearm firing the less-lethal ammunition 100. By increasing pressure in the barrel of the firearm firing the less-lethal ammunition 100, the buffer 110 can result in an increased resulting velocity of the projectiles used in the less-lethal ammunition 100, as generally is understood. The buffer 110 may not be included in some embodiments of the concepts and technologies disclosed herein. In some embodiments, for example, a lower velocity may be desirable and/or discharge of the material used to provide the buffer 110 may be undesirable, and as a result, the buffer 110 may be omitted. Because the buffer 110 may be omitted in additional and/or alternative scenarios, it should be understood that this example is illustrative, and therefore should not be construed as being limiting in any way.

The buffer 110 can be provided by various types of materials, according to various embodiments. In some embodiments of the concepts and technologies disclosed herein, the buffer 110 of the less-lethal ammunition 100 can be provided by walnut grit. In some embodiments, the walnut grit used to provide the buffer 110 of the less-lethal ammunition 100 can include number twelve grit walnut media. It should be understood that this example is illustrative, and therefore should not be construed as being limiting in any way. In some other embodiments, other materials and/or sizes of materials can be used to provide the buffer 110. Variation of the buffer material in the buffer 110 can affect performance of the less-lethal ammunition 100, as generally is understood.

According to various embodiments of the concepts and technologies disclosed herein, one, two, or more than two projectiles 112 can be located in the case 102 on top of the buffer 110. In the illustrated embodiment of the less-lethal ammunition 100, two projectiles 112 can be used. It should be understood that this example is illustrative, and therefore should not be construed as being limiting in any way.

According to various embodiments of the concepts and technologies disclosed herein, one or more of the projectiles 112 used in the less-lethal ammunition 100 illustrated and described herein can be formed from a mixture of plastisol and a weighting material. In some example embodiments, the weighting material can include bismuth, tungsten, steel, or other materials. In some embodiments, bismuth is preferred as bismuth can provide an extremely dense, lead-free, weighting material. In some other embodiments, tungsten can be preferred as another extremely dense, lead-free, weighting material. In various embodiments of the concepts and technologies disclosed herein, the weighting material can be powdered, ground, flaked, and/or otherwise formed into particles. It should be understood that this example is illustrative, and therefore should not be construed as being limiting in any way.

According to one contemplated embodiment of the concepts and technologies disclosed herein, the mixture of plastisol and a weighting material used to form the projectiles 112 of the less-lethal ammunition 100 can be provided by a mixture of bismuth and plastisol, tungsten and plastisol, other weighting materials and plastisol, or other weighting materials and materials that can be similar to or dissimilar to plastisol. In some contemplated embodiments, the mixture used to form the projectiles 112 can be formed by disposing approximately one hundred grams (100 g) of powdered bismuth in sixty milliliters (60 mL) of plastisol. In some embodiments, salt and dye can be added to the mixture.

In another contemplated embodiment, the mixture can be formed by disposing approximately two hundred forty grams (240 g) of bismuth in two hundred forty milliliters (240 mL) of plastisol. Other ratios of the bismuth (or other weighting material) to plastisol can be formed to provide a desired kinetic energy, trajectory, range, and the like. Other mixtures and/or ratios of bismuth (or other weighting material) and plastisol are possible and are contemplated. In some embodiments, the plastisol used can include a member of the LURECRAFT® brand family of materials. In some embodiments, two to four ounces (2-4 oz.) of dye per gallon of plastisol mixture may be included for aesthetic purposes, branding purposes, and/or for other reasons. It should be understood that this example is illustrative, and therefore should not be construed as being limiting in any way.

In various embodiments, the bismuth (or other weighting material) and plastisol mixture can be heated. In some embodiments, the mixture can be heated to about three hundred fifty degrees Fahrenheit (350° F.) and mixed. The temperature to which the bismuth (or other weighting material) and plastisol mixture is heated can be varied depending on the application, the weighting substance used, and/or other considerations.

In some embodiments, the plastisol/weighting substance may be cooled before filling a mold. In particular, the applicant has discovered that cooling the mixture to about three hundred ten to three hundred fifteen degrees Fahrenheit (310-315° F.) before filling molds used to form the projectiles 112 can help prevent the weighting substance from coming out of dispersion and/or settling in the molds. It should be understood that this example is illustrative, and therefore should not be construed as being limiting in any way.

Figure 6:
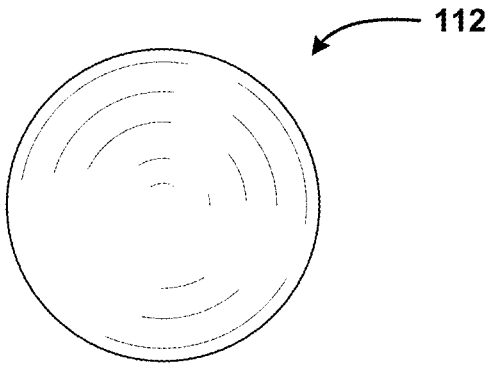
FIG. 6 is a line drawing showing a projectile that can be used in some embodiments of less-lethal ammunition, according to one example embodiment of the concepts and technologies disclosed herein.

The partially cooled mixture can be poured into one or more mold(s) and allowed to cool. The illustrated projectiles 112 shown in FIG. 6 are spherical in shape. It should be understood that this example is illustrative, and therefore should not be construed as being limiting in any way.

According to various embodiments, the projectiles 112 can be formed by a high density plastisol in accordance with the various embodiments illustrated and described hereinabove. A high density plastisol can be made using bismuth, tungsten, steel, iron, other metals, other materials, combinations thereof, or the like. In some embodiments, the percentage of weighting substance by volume of the plastisol/weighting substance mixture used to provide the high density plastisol can be about 10%. In some embodiments, the percentage of weighting substance by volume of the plastisol/weighting substance mixture used to provide the high density plastisol can exceed 20%. In some embodiments, the percentage of weighting substance by volume of the plastisol/weighting substance mixture used to provide the high density plastisol can exceed 30%. In some embodiments, the percentage of weighting substance by volume of the plastisol/weighting substance mixture used to provide the high density plastisol can exceed 40%. In some embodiments, the percentage of weighting substance by volume of the plastisol/weighting substance mixture used to provide the high density plastisol can exceed 50%. In some embodiments, the percentage of weighting substance by volume of the plastisol/weighting substance mixture used to provide the high density plastisol can exceed 60%. In some preferred embodiments, the percentage of weighting substance by volume of the plastisol/weighting substance mixture used to provide the high density plastisol can range from a minimum of about 10% to a maximum of about 60%, though lower and higher percentages are contemplated as explained herein. Of course, in some embodiments of the concepts and technologies disclosed herein, the projectiles 112 can be formed from plastisol without any weighting substance. It should be understood that these examples are illustrative, and therefore should not be construed as being limiting in any way.

The above description has described various materials that can be used to form the projectiles 112 of the less-lethal ammunition 100. In particular, the various embodiments have been described as being formed from plastisol and a weighting substance such as bismuth, tungsten, or other materials. In various embodiments, tungsten is preferred, and in some other embodiments, bismuth is preferred. Tungsten can be preferred in some embodiments because tungsten powder is easily obtained and therefore may be less work-intensive than some alternative materials such as bismuth (which may have to be crushed, etc.). Also, tungsten is, by cubic centimeter, one of the densest materials available on earth, measuring approximately 19.35 grams per cubic centimeter (compared to lead, which measures approximately 11.35 grams per cubic centimeter). Also, the cost of tungsten ($50 or less per pound) can be cheap compared to some other heavy metals (e.g., compared to gold). Thus, tungsten can be a preferred material, in some embodiments. It should be understood, however, that other materials can be used without departing from the scope of this disclosure.

Similarly, while the above description has described use of plastisol as a bearing material for dispersed weighting substance (e.g., bismuth particles, tungsten powder, etc.), it should be understood that other materials are possible and are contemplated. In particular, in some embodiments, silicone, soft plastics, elastic polymers, other polymers, and/or other materials can be used instead of, or in addition to, plastisol. For example, in some embodiments a mixture of silicone and a weighting material can be used to form the projectiles 112. It should be understood that this example is illustrative, and therefore should not be construed as being limiting in any way.

While the above description has also disclosed a percentage of weighting substance from about 10% up to about 60%, these ranges can be adjusted further. The upper limit of the weighting substance can be reached in various ways. For example, an upper limit may be deemed reached if the less-lethal ammunition 100 substantially loses its elasticity due to the percentage of weighting substance (the applicant has discovered that the projectiles 112 may become brittle and/or may lose elasticity at about 90% weighting material to 10% plastisol, though this ratio is not absolute and can change based on temperature, materials used, the size of the particles of the weighting material, etc.).

As another example, an upper limit for percentage of weighting material of the mixture may be deemed reached if the less-lethal ammunition 100 becomes brittle, cracks, or otherwise fails due to the percentage of weighting substance. As another example, an upper limit may be deemed reached if the less-lethal ammunition 100 becomes too expensive in terms of raw materials and/or because of work required to form the less-lethal ammunition 100 due to the percentage of weighting substance. Because limits can be reached in additional and/or alternative manners, it should be understood that these examples are illustrative, and therefore should not be construed as being limiting in any way.

According to various embodiments of the concepts and technologies disclosed herein, an over the shot card 114 can be located on top of the one, two, or more than two projectiles 112. In some embodiments, such as the embodiment shown in FIGS. 1-3, a first over the shot card 114 can be located on top of a first projectile 112 included in the less-lethal ammunition 100 (e.g., under the second projectile 112 and/or in between the first projectile 112 and the second projectile 112), and a second over the shot card 114 can be located on top of the second projectile 112.

As used herein and in the claims, the phrase "on top of" can be used to refer to a first thing that is closer to the exit end of the case 102 than another thing (that the first thing is described as being "on top of"). Similarly, as used herein and in the claims, the phrase "under" can be used to refer to a first thing that is farther from the exit end of the case 102 than another thing (that the first thing is described as being "under"). Thus, it can be appreciated that a last component loaded into the case 102 illustrated and described herein will be at the top of the case 102 and the first thing loaded into the case 102 will be at the bottom of the case 102. It should be understood that this example is illustrative, and therefore should not be construed as being limiting in any way.

Figure 5:
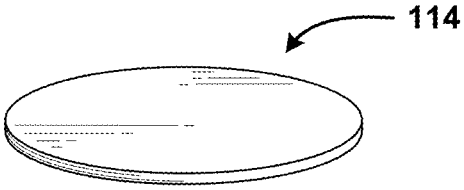
FIG. 5 is a line drawing showing an over shot card that can be used in some embodiments of less-lethal ammunition, according to one example embodiment of the concepts and technologies disclosed herein.

An example of an over the shot card 114 that can be used in accordance with various embodiments of the concepts and technologies disclosed herein is illustrated in FIG. 5. It should be noted that the over the shot card 114 can be any color and/or material such as, for example, LEXAN or other polymers, cardboard, paper, and the like. In the embodiment shown in FIGS. 1-3, the over the shot cards 114 are illustrated as a clear plastic and in FIG. 5 the over the shot card 114 is illustrated as cardboard. It should be understood that in some embodiments, one or more of the over the shot cards 114 can be omitted from the less-lethal ammunition 100, for example by using a star crimp instead of a roll crimp (e.g., by holding the projectiles 112 in place and/or compressing the projectiles 112 using a portion of the case 102 itself), or by using other chemicals, structures, or the like. It should be understood that these examples are illustrative, and therefore should not be construed as being limiting in any way.

In one contemplated embodiment of the less-lethal ammunition 100, the powder charge 300 used in the less-lethal ammunition 100 includes five and one half grains (5.5 gr.) of the VECTAN® brand Ba10 smokeless gunpowder available from Nobel Sport. This powder charge 300 can be loaded into to the case 102 and then a gas seal 108 can be located in the case 102 on top of the powder charge 300. In this specific embodiment, the gas seal 108 used can include an X12X gas seal available from Ballistic Products, Inc. in Corcoran, MN. A buffer 110 in this embodiment can be formed by disposing seventy four grains (74 gr.) of 12-grit walnut powder. Many suitable examples of 12 grit walnut powder are available on the market.

In this example embodiment of the less-lethal ammunition 100, two projectiles 112 can be used. Each of the projectiles 112 can include a 0.680 inch diameter ball, with each ball weighing approximately 5 grams. A first of the two projectiles 112 can be inserted into the case 102, directly on top of (and in contact with) the buffer 110. A first over the shot card 114 can be placed on top of the first projectile 112. A second projectile 112 can be inserted into the case 102, directly on top of (and in contact with) the first over the shot card 114. The second projectile 112 can be covered by a second over the shot card 114. These components can be compressed during crimping of the case 102. Thus, as is visible in FIG. 3, the projectiles 112 can be "pancaked" and/or otherwise compressed after loading. In some embodiments of the concepts and technologies disclosed herein, the compression or pancaking of the projectiles 112 can provide a benefit—namely, the compression of the projectiles 112 can increase back pressure as discussed above, in some embodiments. Fifteen rounds of this embodiment of the less-lethal ammunition 100 were tested and averaged 540 feet per second (the fifteen rounds had the following speeds: 539 fps, 573 fps, 536 fps, 566 fps, 515 fps, 522 fps, 543 fps, 536 fps, 549 fps, 532 fps, 551 fps, 532 fps, 544 fps, and 500 fps) that landed reliably within a 12 inch circle at 50 yards.

Thus, it can be appreciated that some embodiments of the less-lethal ammunition 100 illustrated and described herein (for example, the specific example embodiment described in the paragraph immediately above), can perform consistently and therefore can provide a reliable less-lethal round with an effective range of about 0-50 yards. Also, some embodiments of the less-lethal ammunition 100 illustrated and described herein (for example specific embodiment described in the paragraph immediately above), can provide a single-platform product that can reliably perform as intended over a range of 0-50 yards. In particular, embodiments of the less-lethal ammunition 100 illustrated and described herein (for example specific embodiment described in the paragraph immediately above, do not penetrate ballistic gel at point-blank range, but still reliably deliver their energy to the intended target from a range of 0-50 yards and in some cases, even beyond 50 yards. It should be understood that this example is illustrative, and therefore should not be construed as being limiting in any way.

Figure 7:
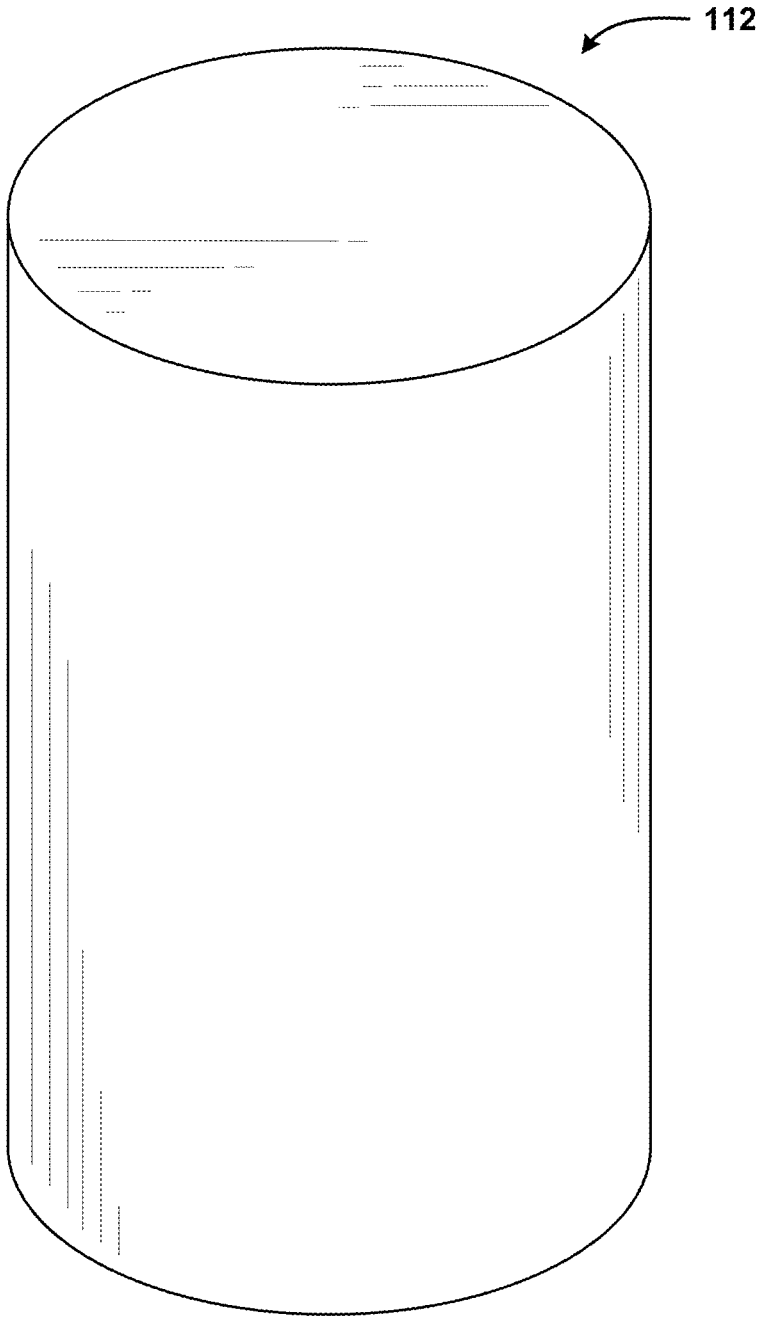
FIG. 7 is a line drawing showing a projectile that can be used in some embodiments of less-lethal ammunition, according to another example embodiment of the concepts and technologies described herein.

Turning now to FIG. 7, another projectile 112 that can be used in less-lethal ammunition 100 is shown. As shown in FIG. 7, the projectile 112 can be formed as a cylinder. The cylinder can be sized to provide a desired weight for the projectile 112. In some embodiments, the projectile 112 shown in FIG. 7 can weigh about 10 to about 20 grams and can be formed by a cylinder having a diameter of about –0.680 inches and a height of about one inch. It should be understood that this example is illustrative, and therefore should not be construed as being limiting in any way.

The projectile 112 shown in FIG. 7 can be used, for example, in less-lethal ammunition 100 that can be used as a "door breacher," in some embodiments. It can be appreciated that the cylindrical projectile 112 shown in FIG. 7 can obviate the need to include a buffer 110, in some embodiments, as the projectile 112 shown in FIG. 7 may itself be heavy enough to create the back pressure needed to burn the powder charge before the projectile 112 is expelled from the barrel of the firearm firing the less-lethal ammunition 100. It should be understood that this example is illustrative, and therefore should not be construed as being limiting in any way. Other shapes and configurations of the projectile(s) 112 used in the less-lethal ammunition 100 are possible and are contemplated.

Figure 8:
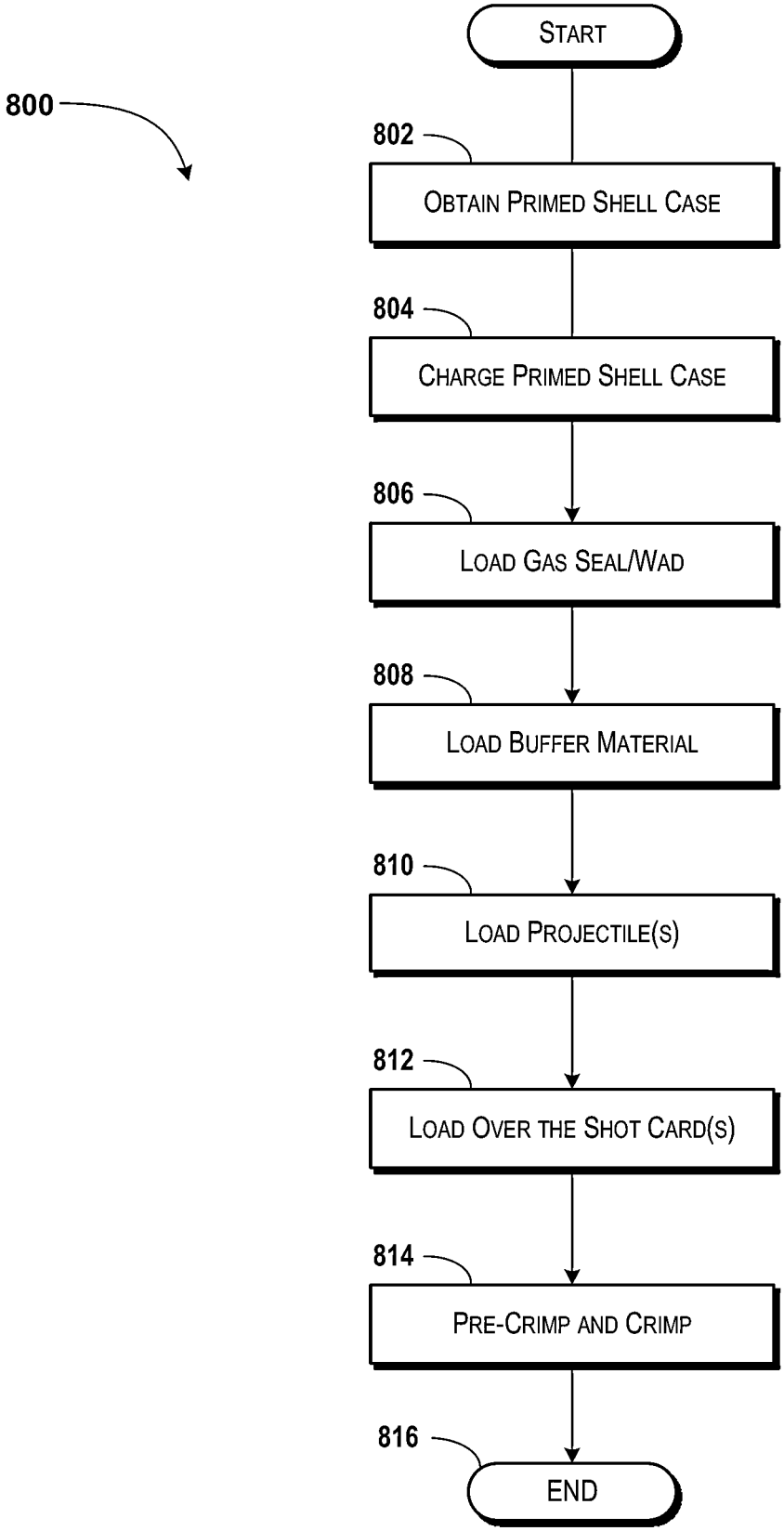
FIG. 8 is a line drawing that schematically illustrates a method for making less-lethal ammunition, according to another example embodiment of the concepts and technologies disclosed herein.

Turning now to FIG. 8, aspects of a method 800 for forming embodiments of less-lethal ammunition 100 will be described in detail, according to an illustrative embodiment. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein.

It also should be understood that the methods disclosed herein can be ended at any time and need not be performed in its entirety. Some or all operations of the methods, and/or substantially equivalent operations, can be performed by execution of computer-readable instructions included on a computer storage media, as defined herein, and executed by a processor of a computer than can control a machine or other device. The term "computer-readable instructions," and variants thereof, as used herein, is used expansively to include routines, applications, application modules, program modules, programs, components, data structures, algorithms, and the like. Computer-readable instructions can be implemented on various system configurations including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein can be implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These states, operations, structural devices, acts, and modules may be implemented in software, in firmware, in special purpose digital logic, and any combination thereof. As used herein, the phrase "cause a processor to perform operations" and variants thereof is used to refer to causing a processor of a computing system or device, such as a less-lethal ammunition manufacturing device, to perform one or more operations and/or causing the processor to direct other components of the computing system or device to perform one or more of the operations.

The less-lethal ammunition manufacturing device can be configured to load less-lethal ammunition 100 and/or form the projectiles 112 of the less-lethal ammunition 100. According to various embodiments of the concepts and technologies disclosed herein, the projectiles 112 can be formed separately by suspending the weighting material in the plastisol (or other suitable material) and pouring the molten (and partially cooled) mixture into a mold. Because the manufacturing process for the projectiles 112 has been explained above and will be further explained below with reference to FIG. 9, the method 800 will be described as a process for loading the less-lethal ammunition 100 illustrated and described herein without addressing forming of the projectile 112. It should be understood that the forming of the projectile 112 can be included in the method 800, in some embodiments, so the illustrated and described embodiment should not be construed as being limiting in any way.

For purposes of illustrating and describing the concepts of the present disclosure, the method 800 is described herein as being performed by the less-lethal projectile manufacturing device via execution of one or more software modules such as, for example, a less-lethal ammunition manufacturing application. It should be understood that additional and/or alternative devices and/or network nodes can provide the functionality described herein via execution of one or more modules, applications, and/or other software including, but not limited to, the less-lethal projectile manufacturing application. Thus, the illustrated embodiments are illustrative, and should not be viewed as being limiting in any way.

The method 800 begins at operation 802. At operation 802, the less-lethal projectile manufacturing device can obtain a primed shell case. In some embodiments, the primed shell case can be similar to the case 102 including the primer 106. It can be appreciated that the less-lethal projectile manufacturing device can obtain an un-primed case 102 and insert the primer 106, or that a supply of primed cases 102 can be provided to the less-lethal projectile manufacturing device. Similarly, it can be appreciated that cases 102 may be reused, and as such operation 802 can include one or more of removing a spent primer from a primer pocket of the case 102, cleaning the primer pocket of the case 102, and inserting a new primer in the primer pocket of the case 102.

Substantially any caliber of case 102 can be used in accordance with the concepts and technologies disclosed herein. Also, because a rimfire version of the less-lethal ammunition 100 can be made in accordance with the concepts and technologies disclosed herein, operation 802 can correspond to obtaining a rimfire shell. As illustrated in FIGS. 1-3, the case 102 can be a 12 gauge case or hull, though other calibers and/or types of ammunition are possible and are contemplated. As such, it should be understood that this example is illustrative, and therefore should not be construed as being limiting in any way.

From operation 802, the method 800 can proceed to operation 804. At operation 804, the less-lethal projectile manufacturing device can charge the primed case obtained in operation 802. The less-lethal projectile manufacturing device can be configured to insert, into the case 102, a pre-defined charge of gunpowder or other propellant, as generally is understood. Thus, operation 804 can correspond to inserting, pouring, or otherwise locating in the case 102 the powder charge 300 illustrated and described herein. It should be understood that this example is illustrative, and therefore should not be construed as being limiting in any way.

From operation 804, the method 800 can proceed to operation 806. At operation 806, the less-lethal projectile manufacturing device can load a gas seal 108 or other type of wad to the case 102. In various embodiments, the gas seal 108 can be inserted into the case 102, on top of the powder charge 300. In some embodiments, multiple gas seals or wads such as the gas seal 108 can be inserted into the case 102 on top of the powder charge 300. It should be understood that this example is illustrative, and therefore should not be construed as being limiting in any way.

From operation 806, the method 800 can proceed to operation 808. At operation 808, the less-lethal projectile manufacturing device can insert a buffer 110 into the case 102, on top of the gas seal 108 or other wad (or multiple gas seals, wads, and/or combination thereof if included). In some embodiments, the buffer 110 can be added as a buffer material such as polishing media (e.g., walnut grit). In some other embodiments, the buffer 110 can be provided by a cloth or foam insert or other material. Thus, it can be appreciated that the buffer 110 can be poured into and/or inserted into the case 102 in operation 808. It should be understood that this example is illustrative, and therefore should not be construed as being limiting in any way.

From operation 808, the method 800 can proceed to operation 810. At operation 810, the less-lethal projectile manufacturing device can load one or more projectiles 112 into the case 102, on top of the buffer 110 (if included). In some embodiments, the projectiles 112 can be formed from plastisol, and in some other embodiments, the projectiles 112 can be formed from a plastisol mixture including bismuth or one or more other weighting substances. The projectiles 112 can be configured to be compressed into the case 102, in some embodiments, during the pre-crimping and/or crimping operations. It should be understood that this example is illustrative, and therefore should not be construed as being limiting in any way.

From operation 810, the method 800 can proceed to operation 812. At operation 812, the less-lethal projectile manufacturing device can load one or more over the shot cards 114 into the case 102, on top of the one or more projectiles 112. As noted above, and as shown in FIGS. 1-3, operations 810-812 can be repeated, with a first projectile 112 being loaded on top of the buffer 110, a first over the shot card 114 being loaded on top of the first projectile 112, a second projectile 112 being loaded on top of the first over the shot card 114, and a second over the shot card 114 being loaded on top of the second projectile 112. These operations can be repeated, if desired, to insert more than two projectiles 112, though only one projectile also can be loaded in some embodiments.

In some embodiments of the concepts and technologies disclosed herein, one or more of the over the shot cards 114 (and at least the last over the shot card 114 inserted into the case 102) can be configured to compress the projectiles 112 and/or to prevent the less-lethal ammunition 100 from leaking materials, being water damaged, or the like. Because the over the shot card 114 can be included for additional and/or alternative reasons, it should be understood that these example reasons for including the over the shot card 114 are illustrative and should not be construed as being limiting in any way.

From operation 812, the method 800 proceeds to operation 814. At operation 814, the less-lethal projectile manufacturing device can perform a pre-crimp and/or crimp operation to crimp the case 102, thereby creating a roll crimp or other type of crimp that can seal the less-lethal ammunition 100. It can be appreciated that other operations can be performed such as painting, gluing, and the like.

From operation 814, the method 800 can proceed to operation 816. At operation 816, the method 800 can end.

Figure 9:
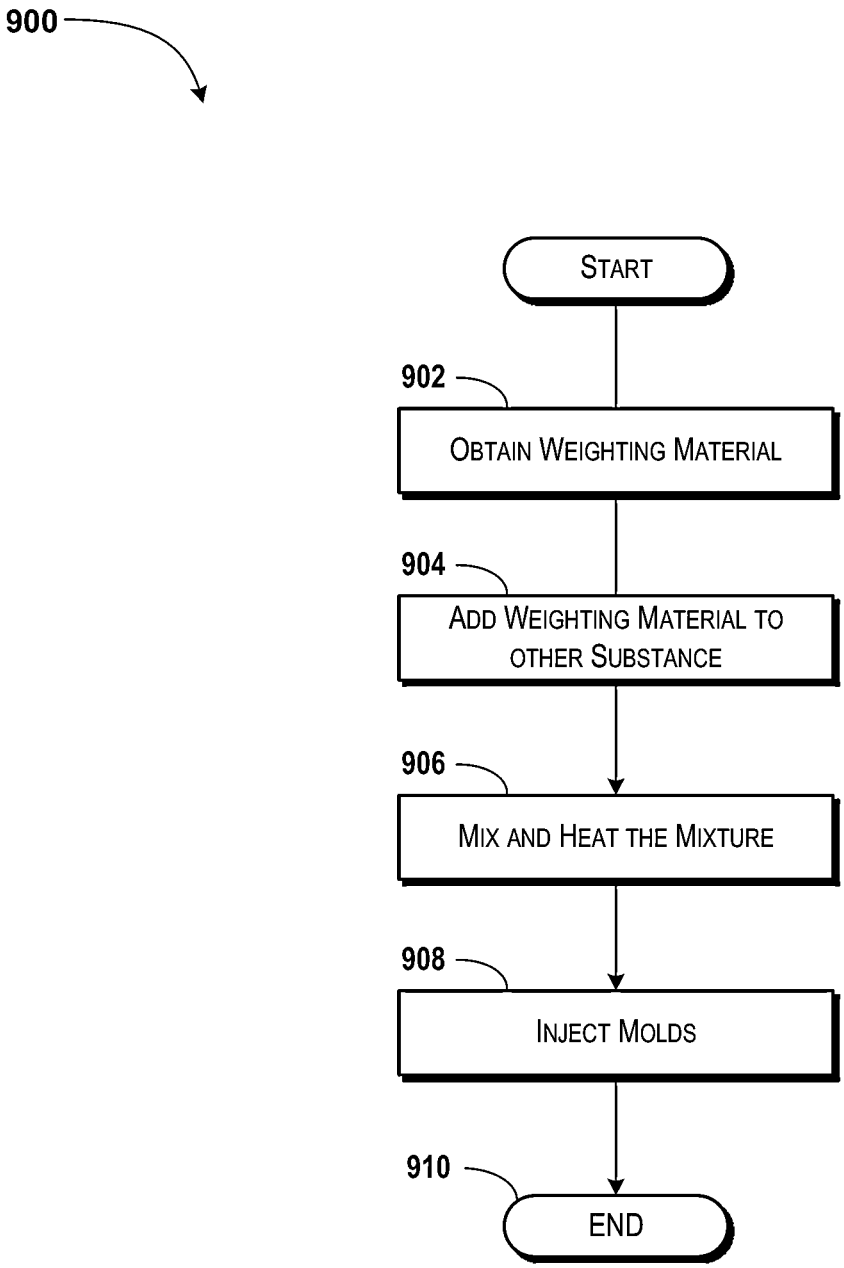
FIG. 9 is a line drawing that schematically illustrates a method for making projectiles for less-lethal ammunition, according to another example embodiment of the concepts and technologies disclosed herein.

Turning now to FIG. 9, an example method 900 for forming projectiles 112 for less-lethal ammunition 100 will be illustrated and described. The method 900 can be performed by the less-lethal projectile manufacturing device and/or other devices.

The method 900 can begin at operation 902. At operation 902, the less-lethal projectile manufacturing device can obtain weighting material in a desired form. In some embodiments, the weighting material can be obtained whole and can be crushed or otherwise altered by the less-lethal projectile manufacturing device. For example, the less-lethal projectile manufacturing device can be configured to crush bismuth or other weighting substance to a desired consistency. In some embodiments, the desired consistency can be such that the bismuth or other weighting substance passes through a number 12 or a number 14 screen. It also should be understood that the bismuth or other weighting substance can be obtained in a desired form (e.g., crushed, powdered, or the like), or crushed by other means (e.g., powdered tungsten can be used, in some embodiments). It should be understood that this example is illustrative, and therefore should not be construed as being limiting in any way.

From operation 902, the method 900 can proceed to operation 904. At operation 904, the less-lethal projectile manufacturing device can add the weighting material (e.g., crushed and sized bismuth or other weighting substance) to plastisol or other material or substance according to a desired percentage. According to various embodiments, more or less bismuth or other weighting substance can be added to the plastisol or other material. In one contemplated embodiment, a mixture can be formed with a ratio of bismuth to plastisol of about 100 grams bismuth to 60 mL plastisol. In another contemplated embodiment, a mixture can be formed with a ratio of bismuth to plastisol of about 240 grams bismuth to about 240 mL plastisol. It should be understood that these examples are illustrative, and therefore should not be construed as being limiting in any way.

From operation 904, the method 900 can proceed to operation 906. At operation 906, the less-lethal projectile manufacturing device can mix and heat the weighting material and the other substance. According to various embodiments, the weighting material and the other substance such as plastisol can be heated to about 350 degrees Fahrenheit. In some embodiments, the mixture can be cooled to about 310 degrees Fahrenheit before injection or pouring into a mold. It should be understood that this example is illustrative, and therefore should not be construed as being limiting in any way.

From operation 906, the method 900 can proceed to operation 908. At operation 908, the less-lethal projectile manufacturing device can inject one or more molds to form the projectiles 112. The molds can have any desired shape such as spherical, conical, and/or other shapes as appropriate to the intended use. The projectiles 112 can be removed from the molds at a desired time, e.g., when the projectiles 112 have solidified enough to be removed from the mold. From operation 908, the method 900 can proceed to operation 910. The method 900 can end at operation 910.

Although the above description has primarily described the use of the projectiles 112 in less-lethal ammunition 100 that can be designed for firing by a shotgun, it should be understood that other types of less-lethal ammunition 100 are possible and are contemplated. For example, in some embodiments, the projectiles 112 can be shaped and formed for use in centerfire or rimfire ammunition in addition to, or instead of, shotgun ammunition. In some other embodiments, the projectiles 112 can be used in black powder firearms, muzzleloader firearms, and/or other devices.

In some embodiments, a less-lethal centerfire cartridge can be formed by obtaining a primed cartridge (aka "brass") for the desired caliber, charging the primed brass, and disposing a projectile 112 in the primed and charged brass. In some embodiments, the projectile 112 may be compressed before disposing the projectile 112 into the brass. In some embodiments, a buffer 110 can be inserted in the charged brass before loading the projectile 112 into the charged brass. Other materials may be included such as, for example, a carrier formed from rubber, plastic, or other material so the integrity of the projectile 112 can be maintained during loading and/or to ensure that the proper backpressure is created during firing as explained above. It should be understood that this example is illustrative, and therefore should not be construed as being limiting in any way.

In another contemplated embodiment, a claymore or grenade can be formed with projectiles 112 such as those illustrated and described herein. Thus, the claymore or grenade, when detonated, can disperse the projectiles 112 outwardly and therefore can be used for crowd control, or the like.

Similarly, another contemplated embodiment of the projectile 112 includes a "door breacher" version such as the example shown in FIG. 7, which can be sized to break a door or the like. The door breacher can be cylindrical or other shapes and can be sized to transfer a great deal of energy to the target (e.g., the projectile can be ten grams, twenty grams, or even heavier, and can be propelled at speeds of four hundred feet per second ("fps"), five hundred fps, or even faster. It should be understood that this example is illustrative, and therefore should not be construed as being limiting in any way.

Another contemplated embodiment of the projectile 112 can be formed for a grenade launcher such as a 37 mm grenade launcher, a 40 mm grenade launcher, or the like, and therefore can be used to provide less-lethal ammunition 100 designed to fire a large less-lethal projectile 112. Also, it should be understood that the projectiles 112 can be formed with a small diameter (e.g., 0.380 inches (buckshot) or even smaller), and can be used as "shot" in shotgun shells in some embodiments. Other contemplated projectiles 112 can be fired in slingshots, muzzle loaders, air cannons, and the like. It should be understood that these examples are illustrative, and therefore should not be construed as being limiting in any way.

Based on the foregoing, it should be appreciated that less-lethal ammunition and methods for making less-lethal ammunition have been disclosed herein. Although the subject matter presented herein has been described with respect to various structural features and/or methodological and transformative acts for forming the less-lethal ammunition and/or the various features thereof, it is to be understood that the concepts and technologies disclosed herein are not necessarily limited to the specific features or acts described herein. Rather, the specific features and acts are disclosed as example forms of implementing the concepts and technologies disclosed herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

The invention claimed is:

1. A less-lethal ammunition comprising:

a case having a first end, a second end, and an interior;

a primer located at the first end;

a powder charge located in the interior, adjacent to the primer;

a gas seal located in the interior, adjacent to the powder charge;

a buffer material located in the interior, adjacent to the gas seal;

a first projectile located in the interior, adjacent to the buffer material, wherein the first projectile is formed from a plastisol mixture;

a first over-the-shot card located in the interior, adjacent to the first projectile;

a second projectile located in the interior, adjacent to the first over-the-shot card, wherein the second projectile is formed from the plastisol mixture; and a second over-the-shot card located in the interior, adjacent to the second projectile and adjacent to the second end.

2. The less-lethal ammunition of claim 1, wherein the plastisol mixture comprises plastisol and a weighting substance dispersed within the plastisol.

3. The less-lethal ammunition of claim 1, wherein the first projectile is spherical.

4. The less-lethal ammunition of claim 1, wherein the plastisol mixture comprises plastisol and between ten and sixty percent by volume of a weighting substance dispersed within the plastisol.

5. The less-lethal ammunition of claim 1, wherein the case comprises a shotgun shell.

6. The less-lethal ammunition of claim 1, wherein the buffer material comprises walnut grit.

7. The less-lethal ammunition of claim 1, wherein the second end comprises an open end of the case, and further comprising a roll crimp of the second end to compress the second over-the-shot card.

8. The less-lethal ammunition of claim 1, wherein the second projectile is compressed between the first over-the-shot card and the second over-the-shot card.

9. The less-lethal ammunition of claim 1, wherein the plastisol mixture comprises plastisol and between twenty and forty percent by volume of a weighting substance dispersed within the plastisol.

10. A less-lethal ammunition comprising:

a case having a first end, a second end, and an interior;

a primer located at the first end and adjacent to the interior;

a powder charge located in the interior, adjacent to the primer;

a gas seal located in the interior, adjacent to the powder charge;

a buffer material located in the interior, adjacent to the gas seal;

a first projectile located in the interior, adjacent to the buffer material, wherein the first projectile is formed from a plastisol mixture comprising plastisol and a weighting substance dispersed within the plastisol;

a second projectile located in the interior, wherein the second projectile is formed from the plastisol mixture; and an over-the-shot card located in the interior, adjacent to the second projectile and adjacent to the second end.

11. The less-lethal ammunition of claim 10, wherein the weighting substance comprises bismuth.

12. The less-lethal ammunition of claim 10, wherein the first projectile is spherical.

13. The less-lethal ammunition of claim 10, wherein the plastisol mixture comprises between ten and sixty percent by volume of the weighting substance.

14. The less-lethal ammunition of claim 10, wherein the plastisol mixture comprises between twenty and forty percent by volume of the weighting substance.

15. The less-lethal ammunition of claim 10, wherein the case comprises a shotgun shell.

16. The less-lethal ammunition of claim 10, wherein the buffer material comprises walnut grit.

17. A less-lethal ammunition comprising:

a case having a first end, a second end, and an interior;

a primer located at the first end and adjacent to the interior;

a powder charge located in the interior, adjacent to the primer;

a gas seal located in the interior, adjacent to the powder charge;

a buffer material located in the interior, adjacent to the gas seal;

a projectile located in the interior, adjacent to the buffer material, wherein the projectile is formed from a plastisol mixture comprising plastisol and a weighting substance dispersed within the plastisol; and an over-the-shot card located in the interior and adjacent to the second end, wherein the over-the-shot card compresses the projectile.

18. The less-lethal ammunition of claim 17, wherein the case comprises a shotgun shell, and wherein the plastisol mixture comprises between ten and sixty percent by volume of the weighting substance.

19. The less-lethal ammunition of claim 17, wherein the case comprises a shotgun shell, and wherein the plastisol mixture comprises between twenty and forty percent by volume of the weighting substance.

20. The less-lethal ammunition of claim 17, further comprising a further projectile adjacent to the projectile, wherein the over-the-shot card compresses the projectile and the further projectile.

* * * * *